US010851606B2

(12) United States Patent
August et al.

(10) Patent No.: US 10,851,606 B2
(45) Date of Patent: Dec. 1, 2020

(54) SUBSEA FLYING LEAD

(71) Applicant: GE Oil & Gas UK Limited, Bristol (GB)

(72) Inventors: Charles Anthony August, Bristol (GB); Robert Dalziel, Bristol (GB)

(73) Assignee: GE OIL & GAS UK LIMITED, Bristol (GB)

( * ) Notice: Subject to any disclaimer, the term of this patent is extended or adjusted under 35 U.S.C. 154(b) by 0 days.

(21) Appl. No.: 15/749,575

(22) PCT Filed: Jul. 29, 2016

(86) PCT No.: PCT/EP2016/068212

§ 371 (c)(1),
(2) Date: Feb. 1, 2018

(87) PCT Pub. No.: WO2017/021325

PCT Pub. Date: Feb. 9, 2017

(65) Prior Publication Data

US 2018/0223620 A1 Aug. 9, 2018

(30) Foreign Application Priority Data

Aug. 6, 2015 (GB) ..... 1513920.7

(51) Int. Cl.
*E21B 33/038* (2006.01)
*E21B 43/013* (2006.01)
*E21B 17/00* (2006.01)

(52) U.S. Cl.
CPC ..... *E21B 33/0385* (2013.01); *E21B 17/003* (2013.01); *E21B 33/038* (2013.01); *E21B 43/013* (2013.01)

(58) Field of Classification Search
CPC .. E21B 17/003; E21B 33/038; E21B 33/0385; E21B 43/013
See application file for complete search history.

(56) References Cited

U.S. PATENT DOCUMENTS 4,346,256 A 8/1982 Hubbard et al.
5,125,847 A 6/1992 Goncalves
5,209,673 A 5/1993 Mohn et al.
5,295,848 A 3/1994 Mohn
(Continued)

FOREIGN PATENT DOCUMENTS

GB 2 231 642 A 11/1990
GB 2 442 104 A 3/2008
(Continued)

OTHER PUBLICATIONS

Swanson, R.C., et al., "Metal Tube Umbilicals—Deepwater and Dynamic Considerations," Offshore Technology Conference, pp. 1-2 (1995) (Abstract).
(Continued)

*Primary Examiner* — Matthew R Buck
(74) *Attorney, Agent, or Firm* — Baker Hughes Patent Organization

(57) ABSTRACT

A subsea flying lead containing a fluid line including a tubing, wherein, in use, an electric current is transmitted along the tubing. Such a flying lead may be used in an apparatus and method for transmitting electricity to a component of an underwater hydrocarbon extraction facility.

21 Claims, 4 Drawing Sheets

(56) References Cited

U.S. PATENT DOCUMENTS

| | | | | |
|---|---|---|---|---|
| 5,745,047 | A * | 4/1998 | Van Gisbergen | E21B 17/003 340/853.1 |
| 8,408,287 | B2 * | 4/2013 | Wittle | E21B 17/003 166/248 |
| 8,857,522 | B2 * | 10/2014 | Arrazola | E21B 34/10 166/363 |
| 2003/0116212 | A1 | 6/2003 | Thomson | |
| 2012/0168168 | A1 * | 7/2012 | Cruden | E21B 33/038 166/338 |
| 2013/0175958 | A1 * | 7/2013 | McJunkin | F16L 55/00 318/400.26 |

FOREIGN PATENT DOCUMENTS

| | | | | |
|---|---|---|---|---|
| WO | 99/06754 | A1 | 2/1999 | |
| WO | 99/31426 | A1 | 6/1999 | |
| WO | WO-0165053 | A1 * | 9/2001 | E21B 17/003 |
| WO | 2006/099048 | A2 | 9/2006 | |
| WO | 2009/153551 | A1 | 12/2009 | |

OTHER PUBLICATIONS

Williams, V.T., et al., "Mensa Project: Hydraulic Umbilicals," Offshore Technology Conference, pp. 1-2 (1998) (Abstract).

Search Report issued in connection with corresponding GB Application No. 1513920.7 dated Sep. 17, 2015.

International Search Report and Written Opinion issued in connection with corresponding PCT Application No. PCT/EP2016/068212 dated Jan. 2, 2017.

International Preliminary Report on Patentability issued in connection with corresponding PCT Application No. PCT/EP2016/068212 dated Feb. 6, 2018.

* cited by examiner

SUBSEA FLYING LEAD

FIELD OF INVENTION

Embodiments of the invention relate to a subsea flying lead, and an apparatus and method for transmitting electricity along the tubing of a fluid line (e.g. a hydraulic line or chemical line) in a subsea flying lead. In one aspect, it relates to an apparatus and method for transmitting electricity between components of an underwater hydrocarbon extraction facility. Such electricity could be used for the purpose of providing power, communication, or both power and communication.

BACKGROUND OF THE INVENTION

Subsea flying leads, for example flying leads included in jumper bundles or mini-umbilicals, are specialised pieces of equipment used in the subsea oil and gas industry which are highly complex. Such flying leads often contain a number of fluid lines and electrical lines, each fluid/electrical line adding to the cost, weight and complexity of the bundle.

It is an aim of embodiments of the present invention to reduce the number of electrical lines between components of an underwater hydrocarbon extraction facility. This aim is achieved by using the tubing of fluid lines (e.g. hydraulic lines or chemical lines) which cannot easily be removed from the facility as electrical conductors. The use of a hydraulic line or chemical line tubing running between two components to transmit electricity removes the need to also have an electrical line connecting the components. This can reduce the size, weight and/or complexity of a subsea flying lead connecting the components, and so reduce the cost of such a bundle.

As prior art there may be mentioned U.S. Pat. Nos. 5,209,673 and 5,295,848, which each disclose combined hydraulic and electric subsea couplings. As further prior art there may be mentioned U.S. Pat. Nos. 5,125,847, 4,346,256A and 8,857,522 which disclose electrically conducting sleeves for fluid conduits. As non-patent literature prior art there may be mentioned a paper titled "Metal Tube Umbilicals—Deepwater and Dynamic Considerations" from the 1995 Offshore Technology Conference (document ID: OTC-7713-MS) and a paper titled "Mensa Project: Hydraulic Umbilicals" from the 1998 Offshore Technology Conference (document ID: OTC-8629-MS), each of which discusses the use of metal tubing for subsea hydraulic umbilicals.

SUMMARY OF INVENTION

In accordance with one aspect of embodiments of the present invention there is provided a subsea flying lead containing a fluid line comprising a tubing, wherein, in use, an electric current is transmitted along the tubing.

The subsea flying lead could further comprising a flying plate, wherein the fluid line terminates in a fluid coupler on the flying plate.

In accordance with another aspect of embodiments of the present invention there is provided an electricity transmission apparatus comprising a subsea structure and a subsea flying lead as described above, wherein the subsea structure comprises a fluid line and a fixed plate, said fluid line terminating in a fluid coupler on the fixed plate, wherein, in use, the fixed plate fluid coupler is coupled to said flying plate fluid coupler.

The subsea flying lead could comprises an electrical connector in its flying plate, and an electrical conductor could run from the tubing of fluid line to the electrical connector. The subsea structure could comprises an electrical connector on its fixed plate, and, in use, the fixed plate electrical connector could be connected to said flying plate electrical connector. The fluid line of the subsea flying lead could comprise a non-conducting section between the flying plate fluid coupler and the point at which the electrical conductor is connected to the tubing of the fluid line.

The fluid line of the subsea structure could comprise a non-conducting section. The subsea structure comprises an electrical conductor connected to the fluid line of the subsea structure at a point between the non-conducting section and the fluid coupler of the fixed plate.

The electrical conductor could be connected to an electrically powered component of the subsea structure.

The fluid line of the subsea flying lead could be, for example, a hydraulic line or a chemical line.

In accordance with an aspect of embodiments of the present invention there is provided method of transmitting an electric current to a component of an underwater hydrocarbon extraction facility, the method comprising the steps of:

providing a subsea flying lead containing at least one fluid line comprising a tubing, said tubing terminating in a fluid coupler in a flying plate;

providing a subsea structure containing at least one fluid line comprising a tubing, said tubing terminating in a fluid coupler in a fixed plate;

connecting flying plate to the fixed plate, such that the flying plate fluid coupler is coupled to the fixed plate fluid coupler;

transmitting an electric current along the tubing; and transmitting, via an electrical conductor, the electric current from the tubing of one of the fluid lines to the component.

The electrical conductor could be connected to the fluid line of the subsea flying lead. The subsea flying lead could comprise an electrical connector in its flying plate, and the electrical conductor could run from the tubing of fluid line to the electrical connector. The subsea structure could comprise an electrical connector on its fixed plate, and, in use, the fixed plate electrical connector could be connected to said flying plate electrical connector. The fluid line of the subsea flying lead could comprise a non-conducting section between the flying plate fluid coupler and the point at which the electrical conductor is connected to the tubing of the fluid line.

The fluid line of the subsea structure could comprise a non-conducting section. The electrical conductor could be connected to the fluid line of the subsea structure at a point between the non-conducting section and the fluid coupler of the fixed plate.

The electrical conductor could be connected to an electrically powered component of the subsea structure.

The fluid line of the subsea flying lead could be, for example, a hydraulic line or a chemical line.

BRIEF DESCRIPTION OF THE DRAWINGS

Embodiments of the invention will now be described with reference to the accompanying drawings, in which.

DETAILED DESCRIPTION

Figure 1:
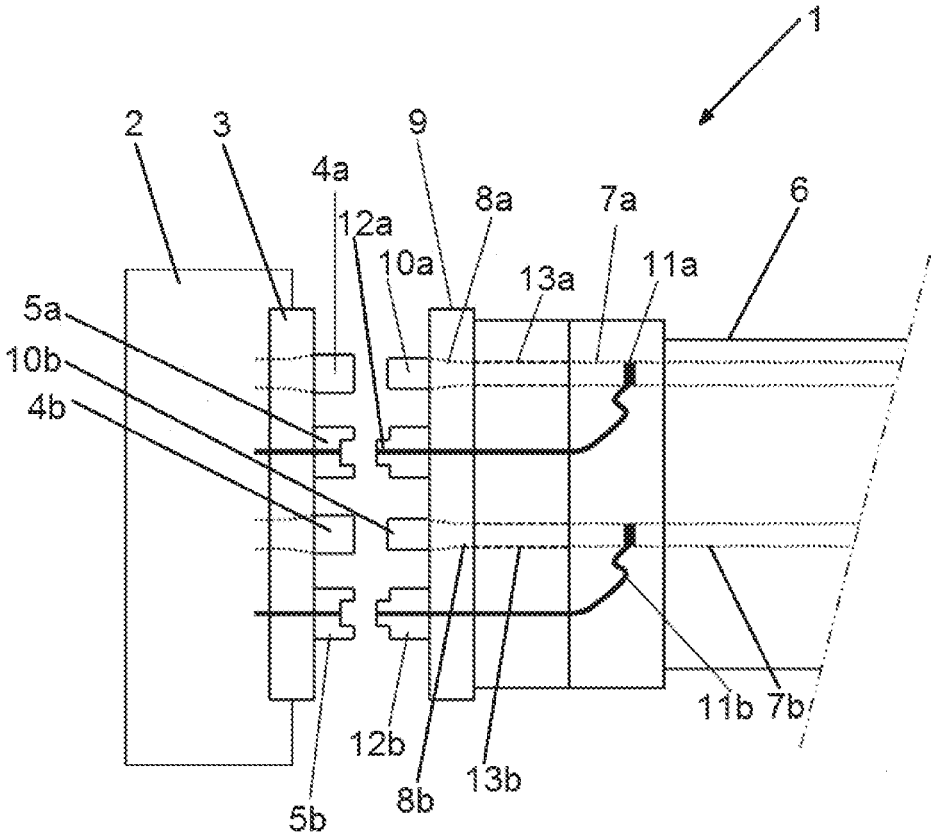
FIG. 1 schematically shows an apparatus in accordance with an embodiment.

FIG. 1 schematically shows an electricity transmission apparatus 1 in accordance with an embodiment the embodiments of the present invention. The apparatus depicted shows how embodiments of the present invention can be retrofitted on already-deployed (so-called 'brownfield') subsea structures.

A subsea structure 2, for example a component of an underwater hydrocarbon extraction facility, comprises a fixed plate 3. The fixed plate 3 includes fluid couplers 4*a*, 4*b* and electrical connectors 5*a*, 5*b*. Each of the fluid couplers 4*a*, 4*b* and electrical connectors 5*a*, 5*b* are female couplers and connectors which are arranged to accept male couplers and connectors from a flying lead 6.

The flying lead 6 is a 'fluid-only' flying lead, i.e. it contains only hydraulic lines and/or chemical lines (hereafter referred to as 'fluid lines'), and no dedicated electrical lines. The fluid lines each comprise a section of metal tubing 7*a*, 7*b* connected to a metal adaptor 8*a*, 8*b* in a flying plate 9, which is in turn connected to a male fluid coupler 10*a*, 10*b*. Each of the male fluid couplers 10*a*, 10*b* is arranged to mate with a respective one of the female fluid couplers 4*a*, 4*b* on the fixed plate 3 of the subsea structure 2.

An electrical conductor 11*a*, 11*b* is attached to each of the sections of metal tubing 7*a*, 7*b* and is connected to a respective male electrical connector 12*a*, 12*b* on the flying plate 9. Each male electrical connector 12*a*, 12*b* is arranged to mate with a respective one of the female electrical connectors 5*a*, 5*b* on the fixed plate 3 of the subsea structure 2.

A non-conducting piece 13*a*, 13*b* is inserted into each fluid line between the metal tubing sections 7*a*, 7*b* and the male fluid couplers 10*a*, 10*b*. This is to prevent the electrification of the flying plate 9, and in turn the fixed plate 3 and the subsea structure 2.

In use, electricity is transmitted along the metal tubing sections 7*a*, 7*b* of the fluid lines in the flying lead 6, and so transmitted to the electrical conductors 11*a*, 11*b*. As the electrical conductors 11*a*, 11*b* are connected to respective ones of the electrical connectors 12*a*, 12*b*, electricity is transmitted to the female electrical connectors 5*a*, 5*b* and from there to a component of the underwater hydrocarbon extraction facility that requires electrical power and/or communication (for example, an electric actuator in a Christmas tree). The non-conducting pieces 13*a*, 13*b*, ensure that electricity is transmitted only to the electrical connectors 12*a*, 12*b*, and so the subsea structure 2 is not electrified generally.

The electricity supplied could be used for the purpose of providing power, communication, or both power and communication. For example, if only power is required by component of the underwater hydrocarbon extraction facility, high voltage direct current (HVDC) or alternating current (AC) may be transmitted down the metal tubing sections 7*a*, 7*b*. If a communication signal is required by component of the underwater hydrocarbon extraction facility, an analogue or digital electrical communication signal could be transmitted down the metal tubing sections 7*a*, 7*b*. If both power and communication are required by component of the underwater hydrocarbon extraction facility, a so-called communication on power signal (COPS) could be transmitted down the metal tubing sections 7*a*, 7*b*, where a power waveform and a communication waveform are combined.

Although a flying lead 6 is shown in FIG. 1, embodiments of the invention are not so restricted, and is also compatible with an umbilical bundle as component 6. Additionally, while a 'fluid-only' flying lead is shown in FIG. 1, embodiments of the invention may also be applied to flying leads which do contain some electrical lines. The use of the tubing as an electrical conductor to eliminate one or more electrical line still results in a reduction in the complexity and cost of a flying lead, even where some electrical lines remain in the flying lead.

Figure 2:
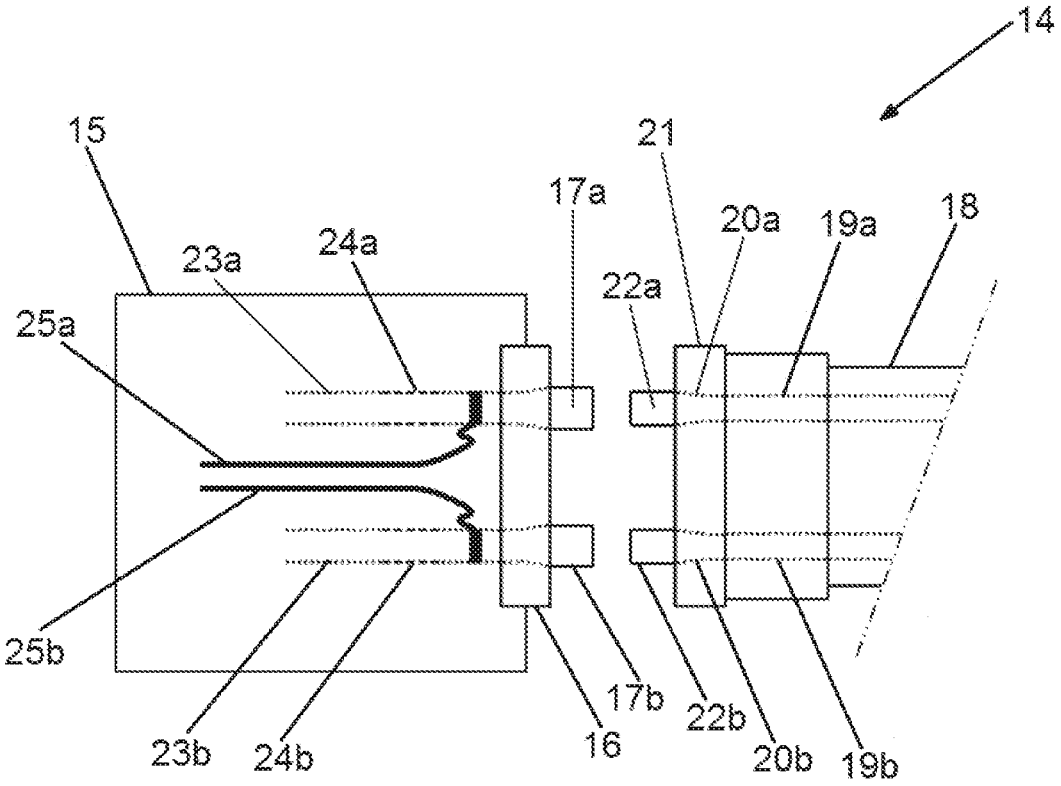
FIG. 2 schematically shows an apparatus in accordance with an embodiment.

FIG. 2 schematically shows an electricity transmission apparatus 14 in accordance with an embodiment of embodiments of the invention. The apparatus depicted shows how embodiments of the present invention can be applied to newly-deployed (so-called 'greenfield') subsea structures.

A subsea structure 15, for example a component of an underwater hydrocarbon extraction facility, comprises a fixed plate 16. The fixed plate 16 includes fluid couplers 17*a*, 17*b*. Each of the fluid couplers 17*a*, 17*b* are female couplers which are arranged to accept male couplers from a flying lead 18.

The flying lead 18 is a 'fluid-only' flying lead, i.e. it contains only hydraulic lines and/or chemical lines (hereafter referred to as 'fluid lines'), and no dedicated electrical lines. The fluid lines each comprise a section of metal tubing 19*a*, 19*b* connected to a metal adaptor 20*a*, 20*b* in a flying plate 21, which is in turn connected to a male fluid coupler 22*a*, 22*b*. Each of the male fluid couplers 22*a*, 22*b* is arranged to mate with a respective one of the female fluid couplers 17*a*, 17*b* on the fixed plate 16 of the subsea structure 15.

The subsea structure also contains fluid lines connected to the female fluid couplers 17*a*, 17*b*. The fluid lines each comprise a section of metal tubing 23*a*, 23*b* connected to a respective one of the female fluid couplers 17*a*, 17*b* via non-conducting pieces 24*a*, 24*b*. Electrical conductors 25*a*, 25*b* are connected to the fluid lines between the non-conducting pieces 24*a*, 24*b* and the female fluid couplers 17*a*, 17*b*.

In use, electricity is transmitted along the metal tubing sections 19*a*. 19*b* of the fluid lines in the flying lead 18, and so transmitted to the metal adaptors 20*a*, 20*b* and the male fluid couplers 22*a*, 22*b*. As the male fluid couplers 22*a*, 22*b* are connected to respective ones of the female fluid couplers 17*a*, 17*b*, electricity is transmitted to the female fluid couplers 17*a*, 17*b* and from there to the electrical conductors 25*a*, 25*b*. The non-conducting pieces 24*a*, 24*b*, ensure that electricity is transmitted only to the electrical conductors 25*a*, 25*b*, and the subsea structure 15 is not electrified generally. The electrical conductors 25*a*, 25*b* transmit the received electricity to components of the underwater fluid extraction facility that require electrical power and/or communication (for example, an electric actuator in a Christmas tree).

Figure 3A:
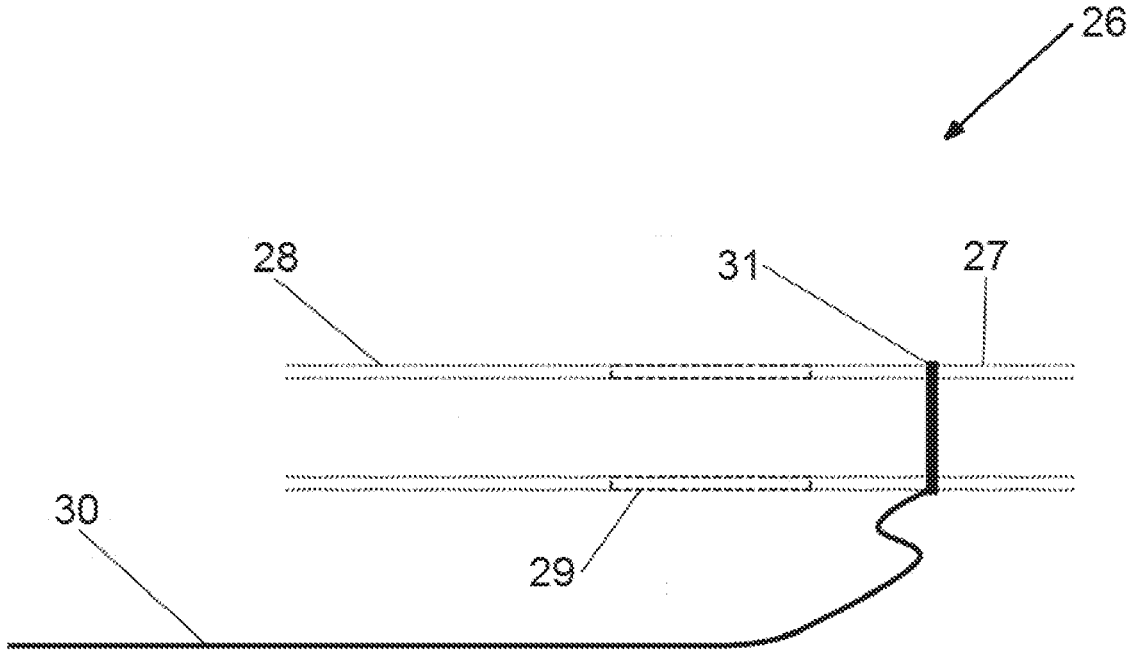
FIG. 3A schematically shows a connection suitable for use where fluid in the fluid line is non-conducting.

FIG. 3A shows an enlarged view of a connection between an electrical conductor and a section of metal tubing in a fluid line 26 suitable for use in embodiments of the present invention. FIG. 3A shows an example of a suitable arrangement where the fluid in the fluid line 26 is a non-conducting fluid. An example of a non-conducting fluid is monoethylene glycol (MEG), which is a common fluid injected into wells to stop hydrate formation and which has a very low conductivity.

The fluid line 26 comprises a first metal tubing section 27 and a second metal tubing section 28. The first metal tubing section 27 is connected to the second metal tubing section 28 via a non-conducting piece 29. An electrical conductor 30 is connected to the first metal tubing section 25.

In use, electricity is received by the first metal tubing section 27 (for example, from a fluid line in a flying lead as shown in FIG. 2). The received electricity is conducted from the first metal tubing section 27 by the electrical conductor 30, which transmits it to components within the facility in which the fluid line is located. As the fluid within the tubing is non-conducting, the non-conducting piece 29 electrically isolates the second metal tubing section 28 from the received electricity, as well as any components in contact with the second metal tubing section 28 downstream.

Figure 3B:
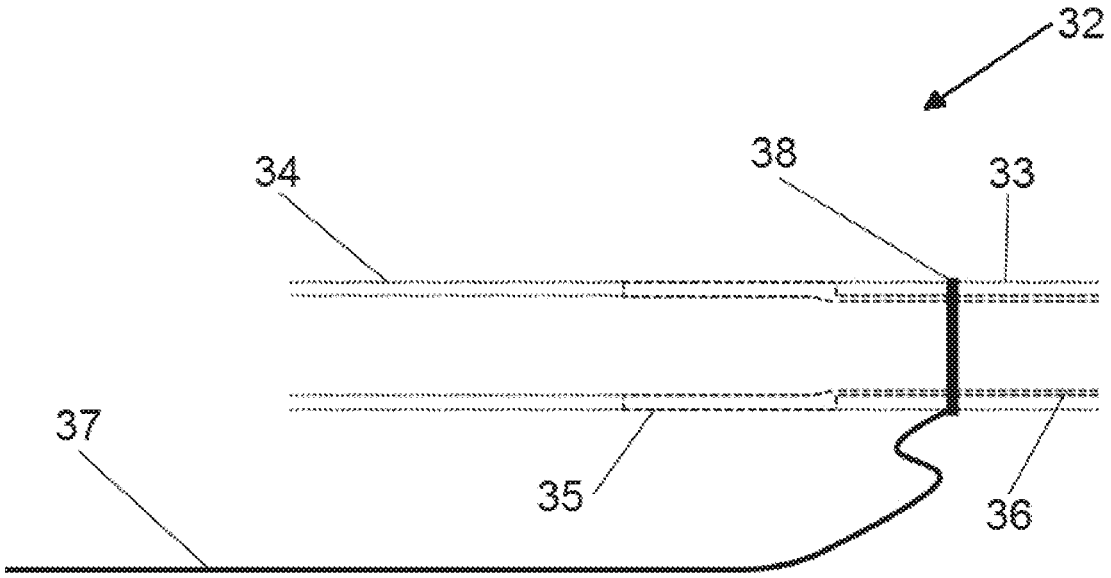
FIG. 3B schematically shows a connection suitable for use, where fluid in the fluid line is conducting

FIG. 3B shows an enlarged view of an exemplary connection between an electrical conductor and a section of metal tubing in a fluid line 32 suitable for use in embodiments of the present invention. FIG. 3B shows an example of a suitable arrangement where the fluid in the fluid line 32 is a conducting fluid. Often, hydraulic fluids used in underwater hydrocarbon extraction facilities are water-based, and so are slightly conducting. Therefore, the connection shown in FIG. 3B is particularly suitable when the fluid line 32 is a hydraulic line.

The fluid line 32 comprises a first metal tubing section 33 and a second metal tubing section 34. The first metal tubing section 33 is connected to the second metal tubing section 34 via a non-conducting piece 35. An electrical conductor 37 is connected to the first metal tubing section 33 via a conducting band 38.

In use, electricity is received by the first metal tubing section 33 (for example, from a fluid line in a flying lead as shown in FIG. 2). The received electricity is conducted from the first metal tubing section 33 by the electrical conductor 37, which transmits it to components within the facility in which the fluid line is located. As the fluid within the tubing is conducting, the non-conducting piece 35 must ensure that the fluid within the tube does not come into contact with both the first metal tubing section 33 and the electrical conductor 37. To achieve this, the non-conducting piece 35 has an extended portion 36 which extends along the inner wall of the first metal tubing section 33 for its entire length. This electrically isolates the fluid within the fluid line and, hence, the second metal tubing section 34 from the received electricity, as well as any components in contact with the second metal tubing section 34 or in contact with the fluid within the fluid line.

The non-conducting piece 35, 36 could be a single unitary piece, or alternatively it could be a combination of a non-conducting piece as shown in FIG. 3A (i.e. a tubing section) in conjunction with an extended section formed of a non-conducting lining applied to the first metal tubing section 33. Such a lining could be applied, for example, by spraying a non-conducting resin onto the inner wall of the first metal tubing section 33, which is then cured and hardened to become fluid-tight. In alternative embodiments, a fluorinated polymer could be used to coat the inner wall of the first tubing section, or a ceramic coating could be used.

Embodiments of the invention are not limited to the specific embodiments disclosed above, and other possibilities will be apparent to those skilled in the art.

For example, while male fluid couplers and electrical connectors have been shown on the flying plate and female fluid couplers and electrical connectors have been shown on the fixed plate, these could easily be reversed. It is immaterial which plate has a male coupler/connector and which has a female coupler/connector, provided they correspond to one another.

While the above embodiments have been described with reference to a flying lead that runs between two subsea components, the same principle could be used on an umbilical cable running between the surface and the seabed. The principle could also be used in a section of a flying lead or umbilical (as opposed to the entire flying lead/umbilical) to eliminate the need for an electrical line in that section.

Where flying leads or umbilicals comprise an armour layer around a fluid line, said armour layer could be used to transmit electricity instead of the tubing itself. In this respect, it is noted that umbilicals often have an armour layer made from metal that surrounds all the tubes within the umbilical and which is itself coated. This armour layer could be used for electricity transmission instead of the fluid line tubing.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A subsea flying lead comprising:

a fluid line comprising a tubing, wherein, in use, an electric current is transmitted along the tubing;

a flying plate, wherein the fluid line terminates in a fluid coupler on the flying plate; and an electrical connector in the flying plate, wherein an electrical conductor runs from the tubing to the electrical connector;

wherein the fluid line comprises a non-conducting section between the fluid coupler of the flying plate and the point at which the electrical conductor is connected to the tubing of the fluid line, wherein in use, the electric current is transmitted along the tubing through the electrical conductor to the electrical connector.

2. The subsea flying lead according to claim 1, wherein the fluid line of the subsea flying lead is a hydraulic line.

3. The subsea flying lead according to claim 1, wherein the fluid line of the subsea flying lead is a chemical line.

4. The subsea flying lead of claim 1, wherein, in use, a fluid coupler of a fixed plate of a subsea structure is coupled to the fluid coupler on the flying plate.

5. An electricity transmission apparatus comprising:

a subsea structure comprising a fluid line comprising a tubing, the fluid line terminating in a fluid coupler on a fixed plate, and a subsea flying lead comprising a flying plate and a fluid line comprising a tubing, the fluid line terminating in a fluid coupler of the flying plate, wherein, in use, the fluid coupler of the fixed plate is coupled to the fluid coupler on the flying plate;

wherein the subsea flying lead comprises an electrical connector in the flying plate, and wherein an electrical conductor runs from the tubing to the electrical connector, and wherein the subsea structure comprises an electrical connector on the fixed plate and, in use, the electrical connector of the fixed plate is connected to the electrical connector of the flying plate.

6. The electricity transmission apparatus according to claim 5, wherein the fluid line of the subsea flying lead comprises a non-conducting section between the fluid coupler of the flying plate and the point at which the electrical conductor is connected to the tubing of the fluid line, wherein in use, an electric current is transmitted along the tubing to the electrical conductor.

7. The electricity transmission apparatus according to claim 5, wherein the fluid line of the subsea structure comprises a non-conducting section.

8. The electricity transmission apparatus according to claim 7, wherein the subsea structure comprises an electrical conductor connected to the fluid line of the subsea structure at a point between the non-conducting section and the fluid coupler of the fixed plate, wherein in use, an electric current is transmitted along the tubing of the subsea flying lead through the electrical conductor to the electric connector of the flying plate, and to the electrical connector of the fixed plate.

9. The electricity apparatus according to claim 8, wherein the electrical conductor is connected to an electrically powered component of the subsea structure.

10. The electricity transmission apparatus according to claim 5, wherein the fluid line of the subsea flying lead is a hydraulic line.

11. The electricity transmission apparatus according to claim 5, wherein the fluid line of the subsea flying lead is a chemical line.

12. A method of transmitting an electric current to a component of an underwater hydrocarbon extraction facility, the method comprising:

providing a subsea flying lead containing at least one fluid line comprising a tubing, the tubing terminating in a fluid coupler in a flying plate;

providing a subsea structure containing at least one fluid line comprising a tubing, the tubing terminating in a fluid coupler in a fixed plate;

connecting the flying plate to the fixed plate, such that the fluid coupler of the flying plate is coupled to the fluid coupler of the fixed plate;

transmitting an electric current along the tubing of the fluid line of the subsea flying lead; and transmitting, via an electrical conductor, the electric current from the tubing of one of the fluid lines to the component.

13. The method according to claim 12, wherein the electrical conductor is connected to the fluid line of the subsea flying lead.

14. The method according to claim 13, wherein the subsea flying lead comprises an electrical connector in the flying plate, and wherein the electrical conductor runs from the tubing of the fluid line to the electrical connector.

15. The method according to claim 14, wherein the subsea structure comprises an electrical connector on the fixed plate and, in use, the electrical connector of the fixed plate is connected to the electrical connector of the flying plate.

16. The method according to claim 15, wherein the fluid line of the subsea flying lead comprises a non-conducting section between the fluid coupler of the flying plate and the point at which the electrical conductor is connected to the tubing of the fluid line.

17. The method according to claim 12, wherein the fluid line of the subsea structure comprises a non-conducting section.

18. The method according to claim 17, wherein the electrical conductor is connected to the fluid line of the subsea structure at a point between the non-conducting section and the fluid coupler of the fixed plate.

19. The method according to claim 18, wherein the electrical conductor is connected to an electrically powered component of the subsea structure.

20. The method according to claim 12, wherein the fluid line of the subsea flying lead is a hydraulic line.

21. The method according to claim 12, wherein the fluid line of the subsea flying lead is a chemical line.

* * * * *